US008028651B2

(12) United States Patent
Rademacher et al.

(10) Patent No.: US 8,028,651 B2
(45) Date of Patent: Oct. 4, 2011

(54) DOSING SYSTEM FOR A COATING PLANT

(75) Inventors: Lothar Rademacher, Bietigheim-Bissingen (DE); Wolfgang Schmid, Lehrensteinfeld (DE)

(73) Assignee: Durr Systems, Inc., Plymouth, MI (US)

( * ) Notice: Subject to any disclaimer, the term of this patent is extended or adjusted under 35 U.S.C. 154(b) by 396 days.

(21) Appl. No.: 12/106,901

(22) Filed: Apr. 21, 2008

(65) Prior Publication Data

US 2008/0271674 A1 Nov. 6, 2008

Related U.S. Application Data

(60) Provisional application No. 60/925,384, filed on Apr. 20, 2007.

(51) Int. Cl.
*B05C 11/00* (2006.01)
*B05B 13/04* (2006.01)

(52) U.S. Cl. ..... 118/684; 118/692; 118/321

(58) Field of Classification Search ..... 118/684, 118/692, 712, 713, 323, 321, 707; 222/55, 222/61, 63, 1; 427/8, 9, 427.2, 427.3; 901/43, 901/41, 30

See application file for complete search history.

(56) References Cited

U.S. PATENT DOCUMENTS

| | | | | |
|---|---|---|---|---|
| 4,483,463 | A | 11/1984 | Buschmann | |
| 6,089,469 | A * | 7/2000 | Fusama et al. | 239/71 |
| 6,329,013 | B1 | 12/2001 | Putt | |
| 6,641,667 | B2 * | 11/2003 | Ochiai et al. | 118/323 |
| 6,726,773 | B1 * | 4/2004 | Yanagita et al. | 118/679 |
| 2008/0210706 | A1 | 9/2008 | Geier et al. | |

FOREIGN PATENT DOCUMENTS

| | | |
|---|---|---|
| CA | 2366733 | 9/2001 |
| DE | 3905236 | 5/1989 |
| DE | 102005044796 | 3/2007 |
| GB | 2218012 | 11/1989 |
| JP | 09029147 | 4/1997 |

OTHER PUBLICATIONS

International Preliminary Report on Patentability.
International Search Report Dated Jul. 11, 2007.

* cited by examiner

*Primary Examiner* — Yewebdar Tadesse
(74) *Attorney, Agent, or Firm* — Rader Fishman & Grauer PLLC

(57) ABSTRACT

A metering system for a coating installation for coating components such as vehicle body parts contains an applicator which applies the coating material supplied to it with a volumetric flow metered on-demand, a regulated first metering device which adjusts the pressure or the volumetric flow of the coating material to be applied by the applicator based on setpoints which are specified by automated installation controls, a transducer to generate a reading which matches the pressure or the volumetric flow of the coating material flowing to the applicator and a control device for regulating the metering device as a function of the specified setpoints and of the reading from the transducer. A second metering device is connected at the outlet of the regulated first metering device for the coating material flowing to the applicator which controls the pressure or volumetric flow of the said applied coating material for precision metering of the coating material applied as a function of the specified setpoints.

20 Claims, 3 Drawing Sheets

DOSING SYSTEM FOR A COATING PLANT

CROSS REFERENCE TO RELATED APPLICATIONS

This application claims priority to U.S. provisional application Ser. No. 60/925,384 filed on Apr. 20, 2007, the disclosure of which is incorporated herein by reference in its entirety.

TECHNICAL FIELD

The present disclosure relates to a metering system for a coating installation specifically for the serial coating of workpieces.

BACKGROUND

When coating workpieces such as vehicle bodies or their parts with paint or other coating materials, such as sealants or adhesives, it is known that the most accurate metering possible of the coating material supplied to the applicator is necessary. Metering is performed on demand, i.e. the volumetric flow (quantity flowed per unit of time) of the coating material supplied to the applicator during coating must be adjustable as a function of the specific sub-areas of the workpiece with great precision and short response times, where the individual setpoints are saved in the master controls for the installation and are specified thereby.

The requirements for metering systems for coating installations are in practice substantial and to some extent hard to implement, primarily the requirements for accuracy which in many cases must be absolute and with respect to metering fluctuations be at the least ±1% from the setpoint, with a high degree of reproducibility during fluctuations in temperature, viscosity and pressure. Because of the required accuracy, stepless volume control is preferably required. The components of the metering system must, among other things, be free of dead space to prevent curing. Special requirements apply when metering particular coating materials, such as NAD material (non-aqueous polymer dispersion), for which special measuring devices are required, or when high metering pressure is reached during the application of certain materials, up to 400 bar for example in the case of PUR. Different conditions apply with respect to volumetric flow, the quantity flowed, which in typical cases can be between 2 and 50 ccm/sec, for example. Additional requirements relate to the acceptable system rise and reaction times (<40 ms until reaching ±5% of the setpoint), freely programmable adjustability of feed pressure with low reaction time (<100 ms) and automatic, dynamic adjustment of feed pressure with changes in coating material viscosity, the possibility for automatic calibration with material changes and low delay times at the start of operations. Generally, not only the costs for the installation and its maintenance but the weight and dimensions of the system components should be as low and small as possible, in particular with respect to assembly in or on application robots.

Various metering systems with continuous or discontinuous metering of the coating material are known for coating installations. Continuous metering systems have advantages in principle such as relatively small expenditure (low costs), continuous material flow, wide metering range, short cycle times or refill times and compact dimensions. However, known continuous metering systems are too inaccurate for many applications. They may contain pressure regulators with simple control loops with which only pressure regulation or, by using a flow metering cell, volume control can be performed, or flow regulators in whose control loops, for example, control valves may be used as actuator and flow metering cells as actual value transducers. Apart from their relatively low metering accuracy, these metering systems are intrinsically relatively slow to react to changes in setpoints, which, for example, noticeably diminishes coating quality when applying adhesive beads or when sealing seams because of the skips when they switch on and off, particularly at the beginning and end of the beads, but also with changes in volume on the applied bead. In addition, continuous metering systems which meter volumetrically using geared metering pumps are known and customary. Discontinuous metering systems on the other hand typically contain piston metering units which are known as designs for single or dual metering units with electrical servo metering drive and which can operate without a closed control loop, but which are praticably controlled pressure-dependent. A pressure regulator may be conveniently installed upstream of the metering system to ensure as constant an inlet pressure as possible.

With regard to the prior art, reference is made to Dürr/Behr Technical Manual 02/1994 "Color Volume Control"; DE 38 22 835; DE 691 03 218 T2; DE 100 65 608; EP 1 287 900; EP 1 314 483; EP 1 346 775; EP 1 474 161; and patent applications EP 05 111 273 dated Nov. 24, 2005 and DE 10 2005 042 336.1 dated Sep. 6, 2005

With this as the point of departure, there is a need for simple continuous metering with great metering accuracy and short reaction delays.

BRIEF DESCRIPTION OF THE DRAWINGS

While the claims are not limited to the illustrated examples, an appreciation of various aspects is best gained through a discussion of various examples thereof. Referring now to the drawings, illustrative examples are shown in detail. Although the drawings represent the various examples, the drawings are not necessarily to scale and certain features may be exaggerated to better illustrate and explain an innovative aspect of an example. Further, the examples described herein are not intended to be exhaustive or otherwise limiting or restricting to the precise form and configuration shown in the drawings and disclosed in the following detailed description. Exemplary illustrations of the present invention are explained in detail by referring to the drawings as follows.

DETAILED DESCRIPTION

Figure 1:
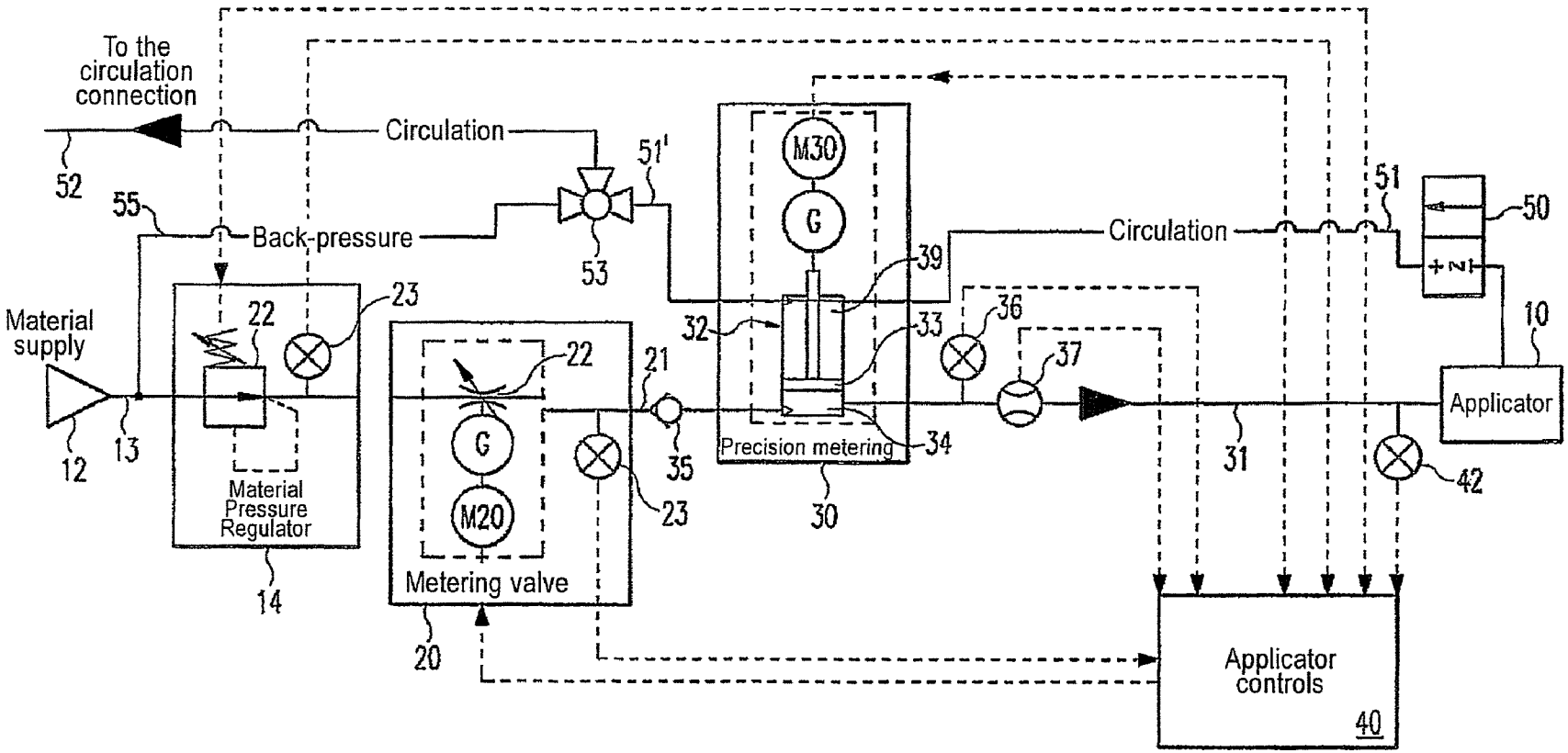
FIG. 1 shows a multi-stage metering system in accordance with one exemplary illustration.

This object is achieved by the various exemplary illustrations described herein.

The dual- or multi-stage metering system described here can be realized with low expenditures for construction, control and maintenance as a pure flow through system with the potential for continuous infinite metering which, in contrast to known continuous systems, has the advantage of the greatest possible metering accuracy (normally less than 1% deviation from the setpoint). Comparable accuracy could be achieved previously only with discontinuous piston metering units.

The system works on the master-slave principle, with the first metering stage as the master and the second metering stage as the slave. An advantageously simple, compact, low-cost and low-maintenance metering device of a known type can be conveniently used for the first metering stage, such as a low-wear and low-maintenance volumetric flow regulator with a metering valve as the actuator or an even simpler metering pressure regulator. For the second metering stage required for precision metering on the other hand, a piston metering device can be used, for example, which may be similar to conventional piston metering units but which, in contrast to said units, does not transfer discontinuously with periodic filling and emptying but has only to pressurize the coating material coming in a continuous flow from the first metering stage to increase or reduce the volumetric flow. Because of this difference in operating principles, the precision metering unit can be smaller, more compact and lighter than discontinuous piston metering units, as a result of which it is particularly well suited for installation in or on a robot arm (e.g. on axis 3) or traveling (on axis 7), which in turn contributes to increased metering accuracy because of the short distance of the metering system from the applicator. Since the precision metering unit is mechanically less stressed, it is also less susceptible to wear than normal piston metering units.

The first metering device preferably operates in closed loop. Precision metering, on the other hand, does not have to take place in all cases in its own closed loop. Similar advantages result when other devices are used as precision metering units, including continuously flowing metering pumps or those operating with a continuous volumetric flow of an intrinsically known type, whose transferal effect can be reversed so that they can both increase as well as reduce the pressure or volumetric flow of the coating material, and whose drive motor can be regulated to correct the pressure or volumetric flow value set by the first metering device. Simple gear metering pumps, valveless rotary piston pumps (EP 1 348 487) or double-acting piston pumps (similar to those in accordance with patent application EP 05 111 273.8 or 4-valve high-pressure pumps such as those from the Rexson company) can be considered. Screw pumps known per se operating with rotary spindles intended for other purposes may be used conveniently.

A further possibility is precision metering using a setpoint-dependent controlled applicator nozzle as the second metering device, for example, in closed loop operation in the manner intrinsically known from EP 1 346 775, whereby the main needle valve of an atomizer which can also contain the electric or pneumatic drive for this metering valve and/or a suitable volumetric flow measuring device serves as the actuator.

In the case of the system described here, the precision metering unit usually only intervenes when the flow rate set by the upstream metering stage does not exactly match the specified setpoints and has to be corrected. Depending on the application, the precision metering unit can adjust pressure or volume for the coating material. It is particularly advantageous that the precision metering unit can implement the required pressure adjustment at extremely short notice with sudden changes in the setpoint for pressure or discharge rate. The same applies, for example, to the requisite over-control when compensating for hose permeability known from EP 1 481 736. As a result, when sealing seams for example, application quality is substantially improved, particularly at the beginning and end of the applied seam.

Besides the benefit of shorter reaction times during rapid changes in volume or pressure during the ongoing application process, the exemplary illustrations disclosed herein have additional advantages such as the potential for the precisely metered application both of very small as well as large volumetric flows and universal applicability for different coating tasks and materials. The materials that can be metered in accordance with the exemplary illustrations include, for example, thixotropic material, NAD material and PUR.

The exemplary illustrations are certainly suitable for any coating materials including paint, and may be especially beneficial for use with high-viscosity coating material, such as is required in adhesive applications (such as door seam bonding on vehicle bodies), for underbody protection or in applying sealants. For example, when sealing seams with airless atomization in which unlike rotary or air atomization, as generally is known, the coating material is atomized solely by the inlet pressure of the application nozzle and the application quantity is accordingly determined directly by the pressure at the nozzle. Similar advantages accrue in the case of material applied by air atomization for underbody protection. The exemplary illustrations disclosed herein are generally always advantageous when a specified feed pressure has to be set before opening the main valve (e.g. the main needle) of the applicator.

As was already mentioned, the pressure or the volumetric flow of the coating material being supplied to the applicator can be regulated using the system described here, in both cases with the objective of a precise and needs-dependent regulatable metering of the applied coating material. With pressure control, it can be assumed that a known, precisely determined discharge volume figure for the applied material corresponds to each pressure value at the inlet of the applicator, said value being given as a compensating function for other factors such as temperature and/or viscosity, for example from the geometric shape and size of an application nozzle. With pressure control, a nozzle matching the regulated pressure must be used for the desired metering or for a given nozzle the matching pressure must be generated at the nozzle. It depends on the practical requirements of the particular application whether pressure or volumetric flow is regulated. For example, the particular coating material can play a part, but, for the same material, a pressure regulating system may be preferred because of its lower cost, or a volumetric flow control system may be preferred because of its greater precision.

The metering system shown in FIG. 1 is designed such that it can be used optionally either for pressure regulation or volumetric flow regulation. Thus, not all components are needed for the specific case.

The coating material to be applied by an applicator 10, for example sealing material required for vehicle bodies or their parts, is provided by a material supply device 12 through an inlet line 13 and a material pressure regulator 14 of a first metering unit 20 and from there through a connecting line 21 to a second metering device 30. From the outlet of the second metering device 30, the coating material flows through a line 31, for example a hose, to the inlet of the applicator 10. Material provision is effected by the pressure prevailing in lines 13, 21 and 31. The broken lines represent, for example, electrical or pneumatic signal control lines.

The material pressure regulator 14 serves to adjust the feed pressure of the metering system at the material inlet of the first metering device and, for this purpose, contains an adjusting valve 22 interposed in the inlet line 13 and an associated pressure sensor 23. The adjusting valve 22 can be controlled in a known way by a control device (not shown) contained in the application controls 40 in the closed loop as a function of the actual pressure reading, which is measured by the pressure sensor 23 at the material outlet of the adjusting valve 22, and a specified desired feed pressure actual value. The material pressure regulator 14 is adjusted to a constant material pressure which is higher than the required maximum pressure in the system during application operation.

The first metering device 20 contains a metering valve 22 interposed in the connecting line 21 which acts in a known way as an actuator for a closed control loop and is actuated, for example, by a reversible electric motor M20 with an associated gear G, and its own pressure sensor 23 which measures the pressure at the material outlet of the metering valve 22. An associated control device (not shown) similarly contained in the application controls 40 can regulate the motor M20 as a function of the actual pressure value from the pressure sensor 23 and/or as a function from an actual pressure sensor at the outlet of the second metering device 30 and of the setpoints compared in the usual way with the actual value. The setpoints can be changed as needed for the desired metering of the coating material during application and are specified for the control loop by the central automated installation controls (not shown).

The second metering device 30 is for the precision metering of the coating material and, in the example shown, contains a cylinder unit 32 in which a piston 33 is slideable in both directions by a reversible motor M30 through a gear G. The piston delimits the confines of the first cylinder chamber 34 which has a material inlet attached to the connecting line 21 and a material outlet attached to the line 31 and additionally has a pressure-tight seal. The cylinder unit 32 can be identical in design to the piston metering units intrinsically known from coating installations (for example EP 1 252 936, EP 1 314 483, EP 1 384 885, etc.) or also piston pumps known per se, but from which it differs by its function and method of operation as the actuator of a closed feedback control loop which is different in principle and will be explained in what follows. The connecting line 21 contains a non-return valve 35 between the material outlet of the first metering device 20 and the material inlet of the first cylinder chamber 34 to prevent any pressure blowback through the precision metering unit to the metering valve 22 under additional pressure buildup.

An additional pressure sensor 36 is connected to the material outlet of the first cylinder chamber 34 of the precision-metering unit attached to the applicator 10 by line 31, which takes the actual pressure reading it measures to a further control device (not shown) in the application controls 40 which, in one possible method of system operation, can compare the actual value with pressure setpoints (corresponding to the desired discharge volume during application) specified by the central installation controls and convey appropriate control signals to the motor M30 of the precision metering unit. If the pressure of the coating material is too low, it is increased by the drive of the piston 33 in the direction of the cylinder chamber 34, while excessive pressure is reduced by a matching enlargement of the cylinder chamber 34 by the motor M30. The motor M30 is activated only to correct deviations of the actual values from the setpoint values. The piston 33 is mostly stationary during the metered application of the coating material.

When the nozzle of the applicator 10 is closed by the usual main needle valve or similar in pauses during application, it may be practical to use the reading from the pressure sensor 36 which, in the operating mode described above, acts directly on the precision metering unit in accordance with a different function to adjust the static pressure in the system, that is at the material inlet for the precision metering unit. This static pressure can be adjusted by a control device contained in the application controls 40, possibly using the cylinder unit 32.

As shown, in addition to the pressure sensor 36 at the material outlet of the cylinder unit 32 a volumetric flow measuring cell 37 is plumbed into the line 31 which measures the volumetric flow of the coating material flowing to the applicator 10 in a similarly feasible system operating mode and takes this actual reading to the associated control device in the application controls 40. By comparing this actual value with setpoints for the required volumetric flow at that moment or with suitably converted pressure set points, the control device can thus actuate the cylinder unit 32 of the second metering device 30, which is serving as actuator, to control volumetric flow directly.

Since the flow rate measurement cell 37 measures the volumetric flow of the coating material flowing to the applicator 10 which is the result from both metering devices 20 and 30, it can further be practical to actuate in addition the control loop for the first metering device using the reading from the flow rate measurement cell 37. With a knowledge of the individual pressures at the two metering devices, both control loops can be regulated separately. The readings from the flow rate measurement cell 37 can be converted in the application controls 40 into matching pressure readings.

If no control system regulated by volumetric flow is to be implemented, but an exclusively pressure-regulated metering system, the flow rate measurement cell 37 could be dispensed with. In accordance with another exemplary illustration, not shown, it is possible on the other hand to actuate the first metering device upstream of the precision metering unit as a direct function of the volumetric flow measured, for example, in the connecting line 21.

It can be assumed in the case of the functions described above that the pressure or volumetric flow readings at the outlet of the second metering device 30 are in a precisely definable relationship to the corresponding readings directly at the applicator 10. This relationship can be determined during the installation or calibration of the coating facility and then remains unchanged, while negative influences such as hose porosity can be compensated for in a known manner (c.f. EP 1 481 736 and EP 1 298 504). Intrinsically variable factors such as temperature changes and the viscosity of the coating material used can be taken into account mathematically in the application controls 40 by known relationships. In a similar fashion, fixed relationships between pressure and volumetric flow and/or discharge volume can be saved in the application controls when the system is calibrated.

It may also be practical to connect an additional pressure sensor 42 directly at the material inlet of the applicator 10. The reading from this pressure sensor 42 is not necessary for the actual metering regulation in accordance with the explanations above, but, in the applications controls 40 for example, it can help in the adaptation of the system to eliminate the effects of temperature and/or viscosity. In other instances, it may be practical on the other hand to regulate the metering system with the help of a pressure sensor at the applicator, for example for particularly rapid regulation of the metering system.

If no material is being applied with the application nozzle closed, it is practical in many cases not to interrupt the material flow from line 31 to the applicator 10 but to return the coating material continuously in a circulation loop to the material supply ahead of the device 12, for example to prevent changes in the material or settling of the material. The circulation loop can pass through the applicator 10, in a manner intrinsically known from coating installations. To this end, the line 31 leading to the applicator 10 must be connected to a return line 51 by way of a switching valve 50 which is closed during application and is opened when the application nozzle of the applicator 10 is closed.

The circulation loop does not have to go as far as the applicator 10 or even—as in this exemplary illustration—all the way through the applicator 10. As an alternative, the possibility exists with an application robot that the circulation loop extends only as far as one of the robot arms, for example as far the forward arm (robot axis 3). In the exemplary illustration shown, the circulation loop can, as depicted in the drawing, pass through the cylinder unit 32. The return line 51 opens into a material inlet for the second cylinder chamber 39 which is located on the side of the piston 33 opposite the first cylinder chamber 34, and an outlet line 51' connected to a material outlet of the second cylinder chamber 39 then forms the continuation of the circulation loop. The outlet line 51' is connected to the 3-way switching valve 53 depicted from which the circulation loop continues back to the circulation connection 52 ahead of the inlet for the material supply device 12.

The function of the switching valve 53 consists in selectively connecting the cylinder chamber 39 by way of the outlet line 51' in the circulation loop either to the circulation connection 52 or by way of the back-pressure line 55 to the inlet line 13 of the metering system. Since the second cylinder chamber 39 has a pressure-tight seal except for the inlets and outlets for the circulation loop, this layout provides the possibility in a simple way that with the switching valve 50 closed during application, the material supply pressure from the metering system can be applied to the second cylinder chamber 39 by way of the [3-way] switching valve 53. The application of pressure has the advantage that, for the required adjusting motions of the piston 33 for precision metering, the metering drive with the motor M30 has only to generate relatively low forces which are needed to overcome a pressure differential between the two cylinder chambers 34 and 39. The buildup of back pressure advantageously allows a smaller and more compact construction for the precision metering unit with respect to the drive, which in turn makes an improvement in precision and reaction time possible. If the circulation loop does not pass through the cylinder unit 32, the switching valve 53 can be dispensed with and the back pressure in the second cylinder chamber 39 can be taken through line 55 directly from the material supply.

The back pressure in the second cylinder chamber 39 could also be generated by a pressure source separate from the material supply (e.g. a pneumatic system). Furthermore, the pressure value in the second piston chamber 39 assisting the piston movement could be modifiable according to the desired movements of the piston 33, where overpressure or vacuum can result with respect to the first piston chamber 34.

Figure 2:
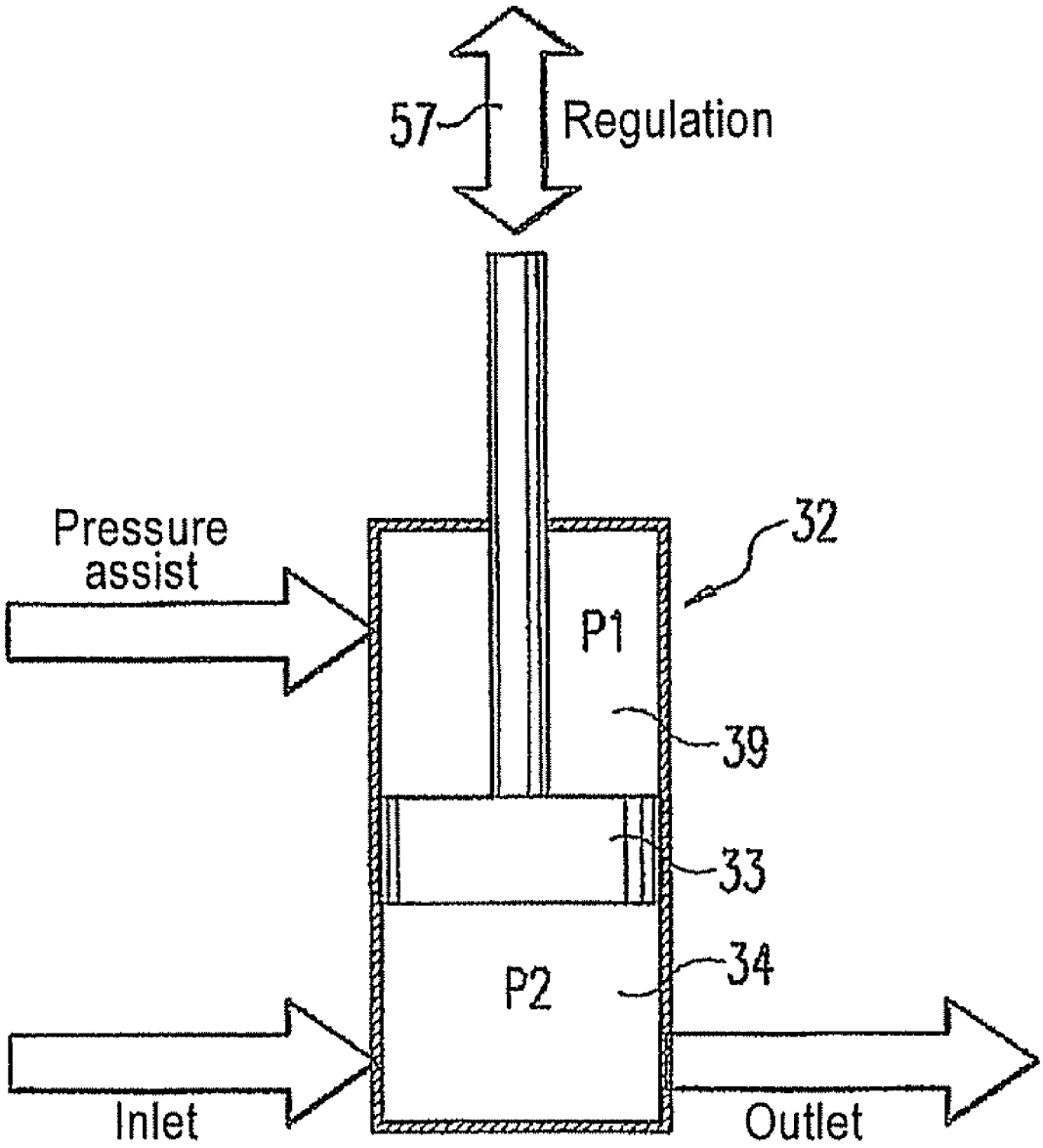
FIG. 2 shows the schematic representation of an actuator which can be used for the control loop of a precision metering unit for the system from FIG. 1.

The principle of using a cylinder unit such as the unit 32 in FIG. 1 as the actuator for a pressure or volumetric flow control loop with pressure assistance in the second cylinder chamber 39 is shown in FIG. 2. The regulating metering drive of the piston 33 indicated by the double arrow 57 only has to overcome the difference between the pressure P2 in the first cylinder chamber 34, through which the material can flow continuously at regulated pressure or volumetric flow, and the assist pressure P1 in the second cylinder chamber 39. An actuator of this kind may be practical for any number of other control loops, beyond the exemplary illustration from FIG. 1, perhaps even without the pressure assist.

Figure 3:
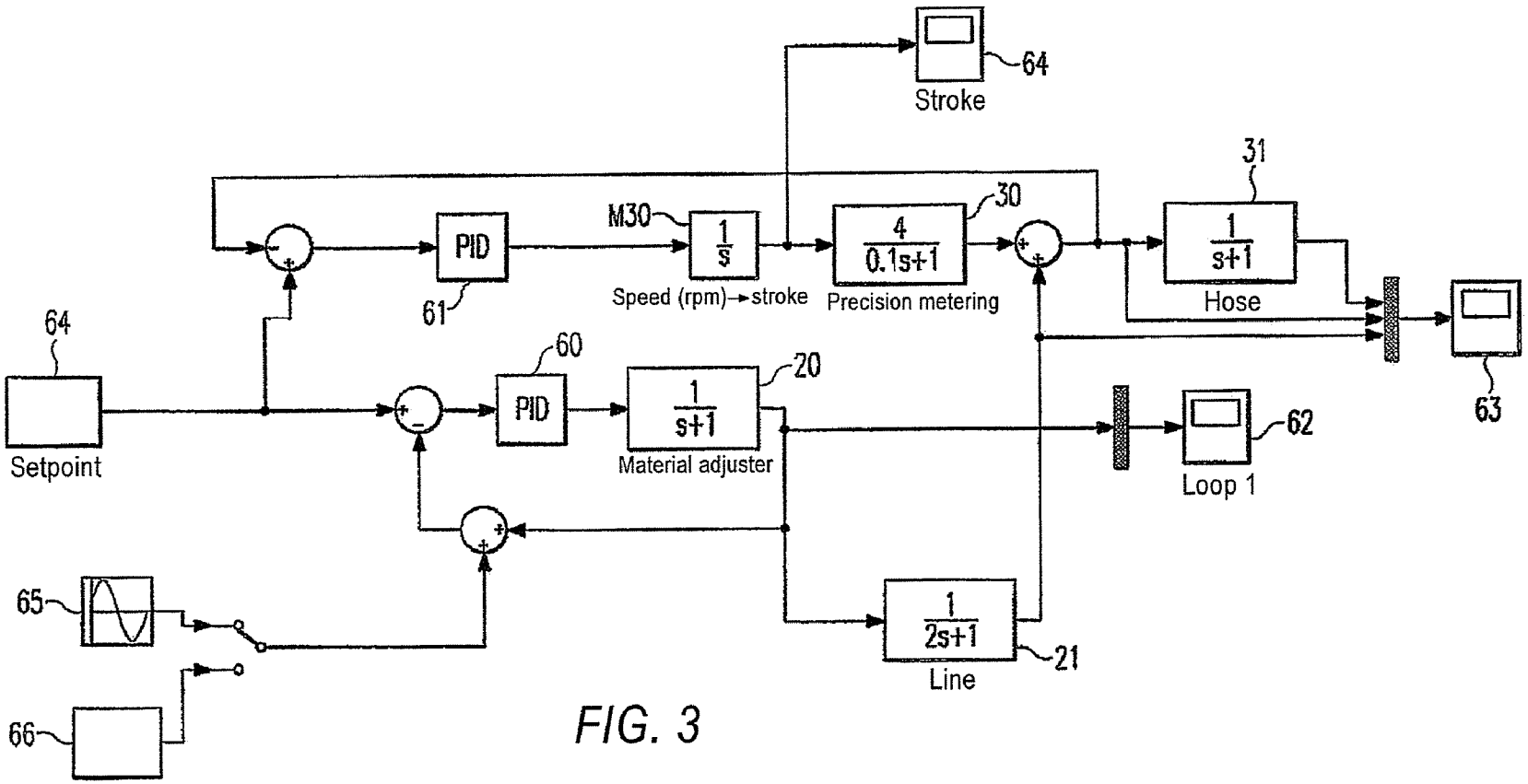
FIG. 3 shows a simplified alternative model of the control system from FIG. 1 in one exemplary illustration as a pressure regulator with precision metering.

FIG. 3 shows an alternative model for the control loops for the metering system in accordance with FIG. 1, in an exemplary illustration as a pressure regulator with precision metering. It can serve to simulate the regulatory characteristics and to perform calculations which may be necessary to implement the different functions and for the reciprocal adjustment of the controls for the two metering devices with respect to each other.

In accordance with FIG. 1, the first metering device 20 is connected by way of connecting line 21 to the second metering device 30 functioning as the precision metering unit, from which hose 31 leads to the applicator. The associated electronic regulating devices 60 or 61 located in the applications controls 40 (FIG. 1) for the first metering device 20 or for the second metering device 30 can be conventional universal PID controllers which scan the readings from the pressure or flow sensors to perform the target-actual comparison, for example at a scanning interval on the order of 50 ms. As shown in the drawing, both controllers 60 and 61 are regulated by the setpoints shown at 64. In the initial calibration of the system, the relation between volumetric flow and pressure can be read and saved as a "base curve" which can be corrected later in the case of too great a difference during continuous operation. The different functions of the control system, including the metering drive M30 for the precision metering unit identified by rpm and stroke, can be displayed on monitors 62, 63 or 64. With 65 and 66, variables such as undulating pressure fluctuations or failure of the material supply can be selectively simulated manually.

The exemplary illustrations described herein can be modified in various respects and, in particular, simplified. For example, a system can be provided which consists only of the combination of a material pressure control loop regulated by setpoints or of a metering valve with precision metering. The material pressure regulator 14 for damping any pressure fluctuations in material supply is not always necessary. Furthermore, examples are conceivable in which only the second metering device for precision metering is regulated in the closed control loop, but not the upstream first metering device which in this case is regulated only by the setpoints.

Key to FIGS. 1-3

FIG. 1

| | |
|---|---|
| Zum Zirkulationsanschluss | To the circulation connection |
| Zirkulation | Circulation |
| Gegendruck | Back-pressure |
| Materialversorgung | Material supply |
| Materialdruckregler | Material pressure regulator |
| Dosierventil | Metering valve |
| Feindosierung | Precision metering |
| Applikator | Applicator |
| Applikationssteuerung | Applicator controls |

FIG. 2

| | |
|---|---|
| Regeln | Regulation |
| Druckunterstützung | Pressure assist |
| Einlass | Inlet |
| Auslass | Outlet |

FIG. 3

| | |
|---|---|
| Hub | Stroke |
| Drehzahl→Hub | Speed (rpm)→stroke |
| Feindosierung | Precision metering |
| Schlauch | Hose |

-continued

| | |
|---|---|
| Sollwert | Setpoint |
| Materialsteller | Material adjuster |
| Kreis 1 | Loop 1 |
| Leitung | Line |

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A metering system for a coating installation for coating components, comprising:

an applicator configured to apply the coating material at a discharge quantity metered according to at least one predetermined value, a first metering device configured to adjust the pressure or the volumetric flow of the coating material applied by the applicator as a function of setpoints which are specified for it by automated installation controls, a transducer for generating a setpoint which matches the pressure or the volumetric flow of the coating material flowing to the applicator, and a control device for regulating the metering device as a function of the specified setpoints and of a measurement of the transducer, wherein a second metering device is connected at the outlet of the first metering device for the coating material flowing to the applicator which, for the precision metering of the applied coating material, regulates its pressure or volumetric flow as a function of the specified setpoints;

wherein the first metering device and the second metering device which serves for fine metering are each controlled by a dedicated control circuit configured to compare a measured value corresponding to the pressure or the volumetric flow of the coating material flowing to the applicator with the at least one predetermined desired value; and wherein the second metering device includes a piston unit containing a movable piston, by way of whose cylinder chamber adjacent the piston the coating material flows as it is being taken to the applicator, and wherein the piston is configured to be moved by a drive mechanism regulated by the control device to correct the specified pressure or volumetric flow value in the event of deviations from the setpoints.

2. The metering system of claim 1, wherein at least one of the first metering device and the second metering device for precision metering has its own closed loop control system configured to compares a reading corresponding to the pressure or the volumetric flow of the coating material flowing to the applicator with the specified setpoints.

3. The metering system of claim 1, wherein the first metering device includes a pressure regulator controlled by the specified setpoints.

4. The metering system of claim 1, wherein the first metering device includes a volumetric flow regulator controlled by the specified setpoints, the flow regulator having a metering valve as actuator and a controlled electric valve drive.

5. The metering system of claim 1, wherein the transducer for the first and/or the transducer for the second metering device is a pressure sensor or a flow measurement cell.

6. The metering system of claim 1, wherein the transducer is a pressure sensor located at the material outlet of the first metering device and/or at the material outlet of the second metering device.

7. The metering system of claim 1, wherein a flow measurement cell is located as a transducer at the material outlet of the first metering device and/or at the material outlet of the second metering device.

8. The metering system of claim 1, wherein a pressure sensor configured to measure the material pressure is provided at the material inlet of the applicator.

9. The metering system of claim 1, wherein a material pressure regulator is positioned upstream of the material inlet of the first metering device, the material pressure regulator configured to automatically adjust a desired feed pressure for the coating material.

10. The metering system of claim 1, wherein the drive mechanism includes an electric-motor drive.

11. The metering system of claim 1, wherein the piston unit contains two cylinder chambers separated by the piston in which the piston can be moved, where the coating material flows through the first cylinder chamber in the direction of the applicator and a pressure assisting the piston movement is generated in the second cylinder chamber which is located on the side of the piston opposite the coating material.

12. The metering system of claim 11, wherein the pressure in the second cylinder chamber can be modified in accordance with the desired direction of motion of the piston.

13. The metering system of claim 1, wherein during pauses in the coating process in which no material is applied, the coating material taken to the applicator is returned to a material supply device through a circulation loop.

14. The metering system of claim 13, wherein the piston unit contains two cylinder chambers separated by the piston in which the piston can be moved, where the coating material flows through the first cylinder chamber in the direction of the applicator and a pressure assisting the piston movement is generated in the second cylinder chamber which is located on the side of the piston opposite the coating material; and wherein the coating material returning through the circulation loop is taken through the second cylinder chamber.

15. The metering system of one of the claim 14, wherein the assist pressure in the second cylinder chamber is generated at least during application by the material supply pressure in an inlet line leading to the first metering device.

16. The metering system of claim 15, wherein a switching valve is interposed between the inlet line and the circulation loop with which the inlet line can be selectively connected to the second cylinder chamber.

17. The metering system of claim 1, wherein the second metering device is formed by a pump with a continuous flow, wherein the pump is configured such that the action of the pump can be reversed and its drive motor can be regulated to correct the pressure or volumetric flow setpoint specified by the first metering device.

18. The metering system of claim 17, wherein the pump is a gear pump or a rotary piston pump or a screw pump or a piston pump with a piston delivering in both directions.

19. An application robot with a metering system for a coating installation for coating components, comprising:

an applicator configured to apply the coating material at a discharge quantity metered according to at least one predetermined value, a first metering device configured to adjust the pressure or the volumetric flow of the coating material applied by the applicator as a function of setpoints which are specified for it by automated installation controls, a transducer for generating a setpoint which matches the pressure or the volumetric flow of the coating material flowing to the applicator, and a control device for regulating the metering device as a function of the specified setpoints and of a measurement of the transducer, wherein a second metering device is connected at the outlet of the first metering device for the coating material flowing to the applicator which, for the precision metering of the applied coating material, regulates its pressure or volumetric flow as a function of the specified setpoints, wherein the second metering device includes a piston unit containing a movable piston, by way of whose cylinder chamber adjacent the piston the coating material flows as it is being taken to the applicator, and wherein the piston is configured to be moved by a drive mechanism regulated by the control device to correct the specified pressure or volumetric flow value in the event of deviations from the setpoints, and wherein at least the second metering device is located on or in a movable robot member of the application robot.

20. The application robot of claim 19, wherein the first metering device and the second metering device which serves for fine metering are each controlled by a dedicated control circuit configured to compare a measured value corresponding to the pressure or the volumetric flow of the coating material flowing to the applicator with the at least one predetermined desired value.

* * * * *

UNITED STATES PATENT AND TRADEMARK OFFICE

CERTIFICATE OF CORRECTION

PATENT NO. : 8,028,651 B2
APPLICATION NO. : 12/106901
DATED : October 4, 2011
INVENTOR(S) : Lothar Rademacher et al.

It is certified that error appears in the above-identified patent and that said Letters Patent is hereby corrected as shown below:

At column 10, claim number 2, line number 21, change “compares” to -- compare, --

Signed and Sealed this
Eleventh Day of September, 2012

David J. Kappos

David J. Kappos
*Director of the United States Patent and Trademark Office*